US007966997B2

(12) United States Patent
Ito et al.

(10) Patent No.: US 7,966,997 B2
(45) Date of Patent: Jun. 28, 2011

(54) OIL COLLECTING STRUCTURE OF BLOW-BY GAS RECIRCULATION SYSTEM AND OIL COLLECTING DEVICE HAVING THE STRUCTURE

(75) Inventors: Kaoru Ito, Okazaki (JP); Shigeki Yasuhara, Toyota (JP); Tooru Kitamura, Nissin (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 389 days.

(21) Appl. No.: 12/308,115

(22) PCT Filed: Jul. 6, 2007

(86) PCT No.: PCT/IB2007/001876

§ 371 (c)(1),
(2), (4) Date: Dec. 8, 2008

(87) PCT Pub. No.: WO2008/010040

PCT Pub. Date: Jan. 24, 2008

(65) Prior Publication Data

US 2009/0241921 A1 Oct. 1, 2009

(30) Foreign Application Priority Data

Jul. 18, 2006 (JP) ..... 2006-195193

(51) Int. Cl.
*F02M 25/06* (2006.01)
*F01M 13/04* (2006.01)

(52) U.S. Cl. ..... 123/572; 123/54.4

(58) Field of Classification Search ..... 123/572–574, 123/41.86, 54.4–54.8
See application file for complete search history.

(56) References Cited

U.S. PATENT DOCUMENTS

| | | | | |
|---|---|---|---|---|
| 2,240,674 | A * | 5/1941 | Seitz | 123/142.5 R |
| 2,702,534 | A * | 2/1955 | Keylwert | 123/41.86 |
| 5,622,156 | A | 4/1997 | Rose et al. | |
| 5,878,731 | A * | 3/1999 | Bedkowski | 123/573 |
| 6,234,154 | B1 | 5/2001 | Spix | |
| 2002/0000224 | A1 * | 1/2002 | Tscherne et al. | 123/572 |
| 2002/0026928 | A1 * | 3/2002 | Korenjak et al. | 123/572 |

FOREIGN PATENT DOCUMENTS

| | | | |
|---|---|---|---|
| DE | 42 39 108 | A1 | 5/1994 |
| EP | 0 732 484 | A1 | 9/1996 |
| EP | 0 898 060 | A1 | 2/1999 |
| EP | 1 467 069 | A2 | 10/2004 |
| JP | U-61-39423 | | 3/1986 |
| JP | A-1-167406 | | 7/1989 |
| JP | A-1-249913 | | 10/1989 |
| JP | A-2-78723 | | 3/1990 |
| JP | Y2-6-45611 | | 11/1994 |
| JP | A-2003-27955 | | 1/2003 |
| JP | A-2005-140104 | | 6/2005 |

* cited by examiner

*Primary Examiner* — M. McMahon
(74) *Attorney, Agent, or Firm* — Oliff & Berridge, PLC

(57) ABSTRACT

An oil return passage that is open at its upper end to a cam chamber and is open at its lower end to a crank chamber is formed to extend from a cylinder head to a cylinder block. A heat exchanger having a double-pipe structure is housed in the oil return passage. Lubricating oil fed from the cam chamber is passed through an oil-collection outer passage of the heat exchanger, and separated oil fed from a separator case of a PCV system is passed through an oil-collection inner passage of the heat exchanger, so that heat of the lubricating oil is imparted to the separated oil. Thus, water contained in the separated oil is evaporated, and the amount of water flowing into an oil pan can be reduced.

6 Claims, 17 Drawing Sheets

OIL COLLECTING STRUCTURE OF BLOW-BY GAS RECIRCULATION SYSTEM AND OIL COLLECTING DEVICE HAVING THE STRUCTURE

BACKGROUND OF THE INVENTION

1. Field of the Invention

The invention relates to an oil collecting structure of a blow-by gas recirculation system (hereinafter called "PCV (positive crankcase ventilation) system" when appropriate) having an oil separator that separates oil mist (such as engine oil in the form of mist) from blow-by gases of an internal combustion engine installed on, for example, an automobile, wherein the blow-by gases from which the oil has been separated is fed to an intake system of the engine. In particular, the invention is concerned with measures for reducing the water content of the oil collected after being separated from the blow-by gases in the oil separator.

2. Description of the Related Art

An engine for an automobile is provided with a PCV system that serves to vent blow-by gas blowing into the crankcase through clearances between cylinders and pistons, and direct the blow-by gas to the intake system of the engine. Namely, the PCV system is arranged to feed the blow-by gas containing carbon monoxide, hydrocarbon and so forth, into combustion chambers, via the intake system of the engine, so as to prevent the blow-by gas from being released to the atmosphere.

An example of the PCV system as disclosed in Publication No. 6-45611 of examined Japanese Utility Model Application includes an oil separator. The oil separator separates oil mist contained in blow-by gas from the blow-by gas, and the oil thus separated is fed to an oil reservoir, such as an oil pan, while the blow-by gas from which the oil mist has been separated and removed is recirculated or fed back into the intake system of the engine.

In the oil separator, an oil separating mechanism for separating oil mist from the blow-by gas is housed. Various types of oil separating mechanisms are generally known which include one having a plurality of baffle plates placed inside the oil separator so as to provide a blow-by gas channel or channels in the form of a labyrinth, and one having one or more punching plate(s) and one or more baffle plate(s). While the blow-by gas is flowing through the interior of the oil separator, the gas hits inner walls of the baffle/punching plates under inertia, and oil mist is captured due to a so-called inertial collision effect.

As examples of the placement of the oil separator, laid-open Publication No. 61-39423 of unexamined Japanese Utility Model Application discloses an oil separator placed inside a cylinder head cover (hereinafter simply referred to as "head cover") of the engine, and laid-open Publication No. 2003-27955 of unexamined Japanese Patent Application discloses an oil separator placed outside the head cover (for example, between right and left banks in a V-type engine).

The oil that has been separated from the blow-by gas by the oil separator passes through an oil collection path, such as an oil collection pipe, and is collected into the oil pan. The oil collection path is often placed at a position exposed to the outside air, under constraints of installation space, and the interior of the oil collection path thus positioned has a relatively low temperature (for example, about 5° C. in winter). Therefore, in the case where a large amount of water is contained in the oil that is separated by the oil separator and fed toward the oil pan to be collected, the water will not be evaporated, but will be collected along with the oil into the oil pan.

If the above-described situation continues, the water content of the oil stored in the oil pan may increase excessively. In this case, sludge may be produced due to the union or combination of the water and nitrogen oxides (NOx) contained in blow-by gas present in the crankcase. If the sludge is produced in large quantity, the oil may degrade, resulting in deterioration of its lubricating capability, or a blow-by gas ventilation/collection path, and the like, may be blocked by or clogged with the sludge, resulting in a situation where ventilation or collection of the blow-by gas cannot be smoothly performed.

SUMMARY OF THE INVENTION

It is an object of the invention to provide an oil collecting structure of a blow-by gas recirculation system (or positive crankcase ventilation system) in which the water content of oil collected from an oil separator can be reduced. It is another object to provide an oil collecting device having the oil collecting structure.

The principle of the invention is to reduce the water content of oil separated from blow-by gas by an oil separator, by heating the separated oil using lubricating oil for use in an internal combustion engine.

One aspect of the invention is concerned with an oil collecting structure of a blow-by gas recirculation system, including an oil separator that separates oil mist from a blow-by gas, and feeds the blow-by gas from which the oil mist is separated and removed to an intake system of an internal combustion engine while feeding the oil separated from the blow-by gas to an oil reservoir of the engine. In the oil collecting structure, a separated-oil collection passage through which the oil separated from the blow-by gas by the oil separator is fed toward the oil reservoir is formed in a main body of the internal combustion engine, and is located adjacent to an oil return passage through which an oil used for lubricating the interior of the main body of the engine flows downward, so that heat of the oil flowing in the oil return passage is imparted to the oil flowing in the separated-oil collection passage.

In the oil collecting structure of the blow-by gas recirculation system constructed as described above, the blow-by gas introduced from the crankcase into the oil separator is fed to the intake system of the internal combustion engine after oil mist is separated and removed from the blow-by gas. The oil separated from the blow-by gas passes through the separated-oil collection passage, and is fed to the oil reservoir. According to the above aspect of the invention, the separated-oil collection passage is located adjacent to the oil return passage through which the lubricating oil passed through the main body of the engine flows, and heat of the lubricating oil flowing in the oil return passage is imparted to the oil flowing in the separated-oil collection passage. Namely, the oil delivered from the oil separator and flowing in the separated-oil collection passage is heated by the lubricating oil flowing in the oil return passage. As a result, water contained in the oil delivered from the oil separator is evaporated due to the heat, and the water content of the oil stored in the oil reservoir is prevented from increasing, thus reducing the possibility of production of sludge due to the union of water and nitrogen oxides (NOx) contained in the blow-by gas. Consequently, degradation of the oil due to the sludge can be prevented, and a blow-by gas ventilation/collection path, or the like, is prevented from being blocked by or clogged with the sludge, which would otherwise provide an impediment to smooth ventilation or recirculation of the blow-by gas.

As a specific arrangement for permitting heat exchange between the lubricating oil and the oil separated from the blow-by gas, the heat exchanging portion in which the heat of the oil flowing in the oil return passage is imparted to the oil flowing in the separated-oil collection passage may have a double-pipe structure having an outer channel and an inner channel, and one of the outer and inner channels may provide the oil return passage, while the other of the outer and inner channels may provide the separated-oil collection passage.

In this case, the outer channel of the heat exchanging portion may provide the oil return passage, and may communicate with an internal space of a cylinder head so as to collect the oil from the cylinder head, and the inner channel of the heat exchanging portion may provide the separated-oil collection passage, and may communicate with an internal space of the oil separator so as to collect the oil separated from the blow-by gas by the oil separator.

The arrangements as described above make it possible to heat the oil in the separated-oil collection passage with high heat-exchange efficiency without communicating the oil return passage and the separated-oil collection passage with each other. In this connection, an intake vacuum for recirculating the blow-by gas into the intake system of the engine is applied to the interior of a case of the oil separator, and the internal pressure of the separator case is lower than the internal pressure of the oil return passage particularly during high-speed revolution of the engine. However, since the oil return passage and the separated-oil collection passage do not communicate with each other, as described above, air in the oil return passage is inhibited from flowing into the separator case via the separated-oil collection passage. Accordingly, the oil separated in the case of the oil separator can be easily fed to the oil reservoir of the engine via the separated-oil collection passage, thus favorably accomplishing "oil draining" of the oil separator.

As a more specific feature of the separated-oil collection passage, the downstream end of this passage may be immersed in the oil stored in the oil reservoir. For example, the separated-oil collection passage may be provided by a pipe that extends toward the oil reservoir, and the lower end of the pipe may be immersed in the oil stored in the oil reservoir. This arrangement can inhibit back-flow of the blow-by gas in the separated-oil collection passage due to a so-called siphonic effect, thus favorably accomplishing "oil draining" of the oil separator.

A specific type or construction of the internal combustion engine and the placement of the oil return passage and separated-oil collection passage suitable for this type of the engine may be as follows: the internal combustion engine is a V-type multi-cylinder engine having a first bank and a second bank, in which cylinders provided in one of the first and second banks are offset from corresponding cylinders of the other bank in a direction of cylinder alignment in which the cylinders of each bank are aligned, and each of the first and second banks has a dead space formed in one of opposite end portions thereof as viewed in the direction of cylinder alignment such that the dead space of each bank is opposed to the other bank. With the engine thus constructed, the oil return passage and the separated-oil collection passage may be placed in the dead space of one of the first and second banks.

With the above arrangement, the oil return passage and the separated-oil collection passage can be placed by effectively utilizing the dead space, without increasing the size of the engine. It is also possible to increase the inside diameters of these oil passages, thus assuring an improved capability of collecting oil for reuse.

According to the above aspect of the invention, the lubricating oil for use in the internal combustion engine is used for heating the oil separated from the blow-by gas by the oil separator, so that the water content of the separated oil can be reduced. Thus, the possibility of production of sludge due to the union of water and nitrogen oxides in the blow-by gas can be reduced or eliminated, and degradation of oil due to the sludge can be prevented. Furthermore, the blow-by gas ventilation/collection path, or the like, is prevented from being blocked by or clogged with the sludge, which would otherwise provide an impediment to smooth ventilation or recirculation of the blow-by gas.

BRIEF DESCRIPTION OF THE DRAWINGS

The foregoing and further objects, features and advantages of the invention will become apparent from the following description of exemplary embodiments with reference to the accompanying drawings, wherein like numerals are used to represent like elements and wherein.

DETAILED DESCRIPTION OF THE INVENTION

One exemplary embodiment of the invention will be described in detail with reference to the drawings. In this embodiment, an oil collecting structure constructed according to the invention is employed in a V-type eight-cylinder engine (internal combustion engine) for an automobile.

Figure 1:
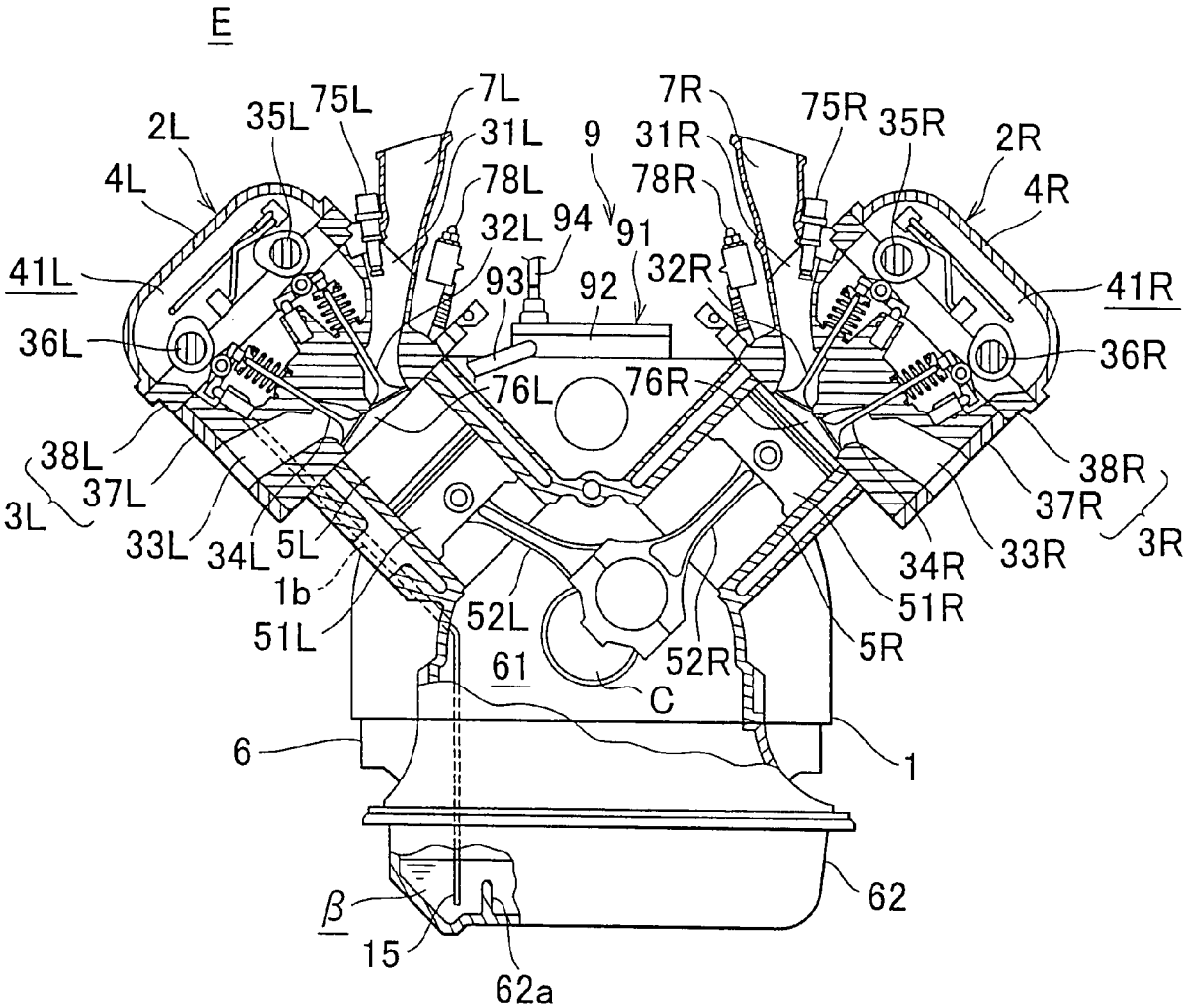
FIG. 1 is a view schematically showing the interior of a V-type engine according to one embodiment of the invention, as viewed in a direction parallel to the axis of the crankshaft.
Figure 2:
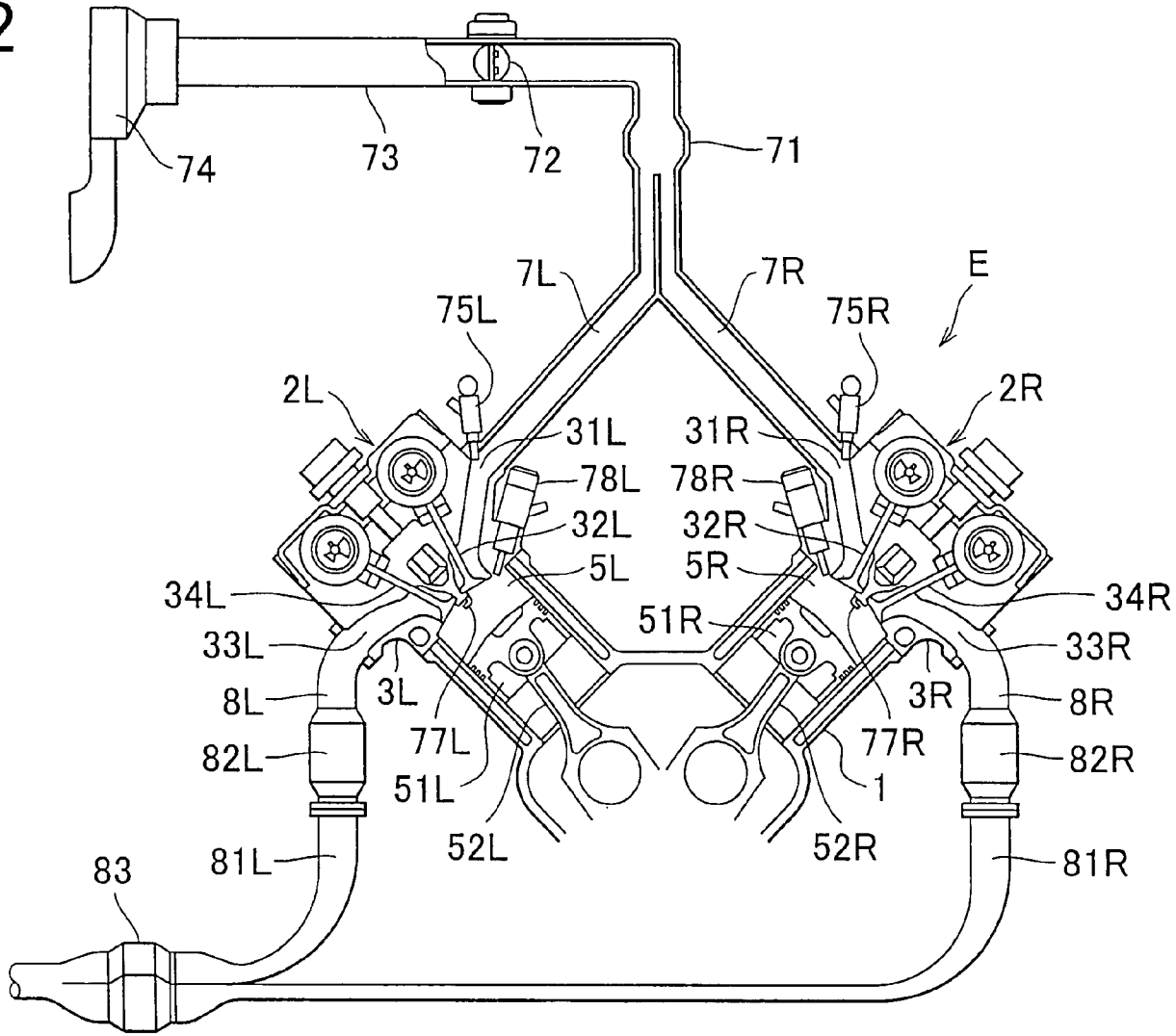
FIG. 2 is a system diagram schematically showing the engine and its intake and exhaust systems.

The overall construction of the engine according to the present embodiment will be explained in advance of explanation of the oil collecting structure. FIG. 1 schematically shows the interior of the V-type engine E of this embodiment as viewed in a direction parallel to the axis of a crankshaft C. FIG. 2 is a system diagram schematically showing the engine E and its intake and exhaust systems.

As shown in FIG. 1 and FIG. 2, the V-type engine E has a pair of banks 2L, 2R that protrude in a V shape above the cylinder block 1. The banks 2L, 2R respectively include cylinder heads 3L, 3R mounted on upper end portions of the cylinder block 1, and head covers 4L, 4R attached to the upper end faces of the cylinder heads 3L, 3R. In the cylinder block 1, a plurality of cylinders 5L, 5R, . . . (e.g., four cylinders for each bank 2L, 2R) are arranged with a certain angle (e.g., 90°) formed between the cylinders 5L, . . . of the bank 2L and the cylinders 5R, . . . of the bank 2R, and pistons 51L, 51R, . . . are housed in the respective cylinders 5L, 5R, . . . such that each piston can reciprocate in the corresponding cylinder. The pistons 51L, 51R, . . . are connected to the crankshaft C via corresponding connecting rods 52L, 52R, . . . , such that power can be transmitted therebetween. A crankcase 6 is mounted underneath the cylinder block 1, and space that extends from a lower portion of the cylinder block 1 to the interior of the crankcase 6 provides a crank chamber 61. Furthermore, an oil pan 62 that serves' as an oil reservoir is mounted underneath the crankcase 6.

Intake valves 32L, 32R for opening and closing intake ports 31L, 31R and exhaust valves 34L, 34R for opening and closing exhaust ports 33L, 33R are mounted in the cylinder heads 3L, 3R, respectively, and camshafts 35L, 35R, 36L, 36R are placed in cam chambers 41L, 41R formed between the cylinder heads 3L, 3R and the head covers 4L, 4R, respectively. In operation, each of the valves 32L, 32R, 34L, 34R is opened and closed in accordance with rotation of the corresponding camshaft 35L, 35R, 36L, 36R.

According to the present embodiment, each of the cylinder heads 3L, 3R of the engine E has a split structure. More specifically, the cylinder head 3L, 3R consists of a cylinder head body 37L, 37R mounted on the upper face of the cylinder block 1, and a camshaft housing 38L, 38R mounted on the upper face of the cylinder head body 37L, 37R. The split structure is adopted for the sake of improvements in the efficiency and easiness with which engine components are assembled together. In assembling, the intake valves 32L, 32R, exhaust valves 34L, 34R, and various components of valve actuating mechanisms are initially put into the cylinder head bodies 37L, 37R, while the camshafts 35L, 35R, 36L, 36R are mounted onto the camshaft housings 38L, 38R. Subsequently, the camshaft housings 38L, 38R are integrally mounted onto the upper faces of the cylinder head bodies 37L, 37R by means of bolts, or the like, to thus provide the cylinder heads 3L, 3R incorporating the valve actuating mechanisms. Thus, the engine components can be assembled together with improved efficiency and easiness.

In the meantime, an intake manifold 7L, 7R associated with each of the banks 2L, 2R is placed above the inner side (between the two banks 2L, 2R) of the corresponding bank 2L, 2R, and the downstream end of each intake manifold 7L, 7R communicates with a corresponding one of the intake ports 31L, 31R, . . . . As shown in FIG. 2, the intake manifolds 7L, 7R also communicate with an intake pipe 73 having a surge tank 71 and a throttle valve 72 which are shared by the two banks, and an air cleaner 74 is provided on the upstream side of the intake pipe 73. With this arrangement, air introduced into the intake pipe 73 through the air cleaner 74 is fed into the respective intake manifolds 7L, 7R via the surge tank 71.

Port injectors (i.e., fuel injection valves for port injection) 75L, 75R are provided in the intake ports 31L, 31R of the cylinder heads 3L, 3R, respectively. When fuel is injected from the port injectors 75L, 75R, air drawn into the intake manifolds 7L, 7R and the fuel injected from the port injectors 75L, 75R are mixed together into air/fuel mixtures, which are then fed into combustion chambers 76L, 76R upon opening of the corresponding intake valves 32L, 32R.

The engine E of the present embodiment is also provided with in-cylinder injectors (i.e., in-cylinder fuel injection valves for direct injection) 78L, 78R. Where appropriate, fuel is injected from the in-cylinder injectors 78L, 78R directly into the combustion chambers 76L, 76R.

As an example of fuel injection scheme using the port injectors 75L, 75R and the in-cylinder injectors 78L, 78R, fuel is injected from both types of injectors 75L, 75R, 78L, 78R under a low- to medium-load condition of the engine E, to produce a homogeneous air/fuel mixture, which can improve the fuel efficiency and reduce emissions. At a high load of the engine E, fuel is injected solely from the in-cylinder injectors 78L, 78R, so as to improve the charging efficiency using the intake-air cooling effect and suppress knocking. It is to be understood that the fuel injection scheme using the above types of injectors 75L, 75R, 78L, 78R is not limited to the specific scheme as described above.

Ignition plugs 77L, 77R are placed in the top sections of the combustion chambers 76L, 76R, respectively. Upon ignition of the ignition plugs 77L, 77R, combustion pressures of the air/fuel mixtures developed in the combustion chambers 76L, 76R are transmitted to the pistons 51L, 51R to reciprocate the pistons 51L, 51R. The reciprocating motion of the pistons 51L, 51R is transmitted to the crankshaft C via the connecting rods 52L, 52R, to be converted into rotary motion that provides the output power of the engine E. Each of the camshafts 35L, 35R, 36L, 36R is rotated or driven with power transmitted from the crankshaft C to the camshaft via a timing chain, and the rotation of the camshafts 35L, 35R, 36L, 36R causes opening and closing movements of the corresponding valves 32L, 32R, 34L, 34R.

The air/fuel mixtures that have burned produce exhaust gases, which are discharged into exhaust manifolds 8L, 8R when the corresponding exhaust valves 34L, 34R are opened, as shown in FIG. 2. Exhaust pipes 81L, 81R are respectively connected to the exhaust manifolds 8L, 8R, and catalytic converters 82L, 82R incorporating three-way catalysts, or the like, are mounted in the exhaust pipes 81L, 81R. In operation, exhaust gases are passed through the catalytic converters 82L, 82R, so that hydrocarbon (HC), carbon monoxide (CO) and nitrogen oxides (NOx) are removed from the exhaust gases. The exhaust pipes 81L, 81R are joined together at the downstream ends, to be connected to a muffler 83.

Next, a PCV system 9 serving as a blow-by gas recirculation system will be described. The PCV system 9 serves to direct blow-by gases that blow into the crank chamber 61 through clearances between the inner walls of the cylinders 5L, 5R and the outer surfaces of the pistons 51L, SiR, into the intake system.

Figure 3:
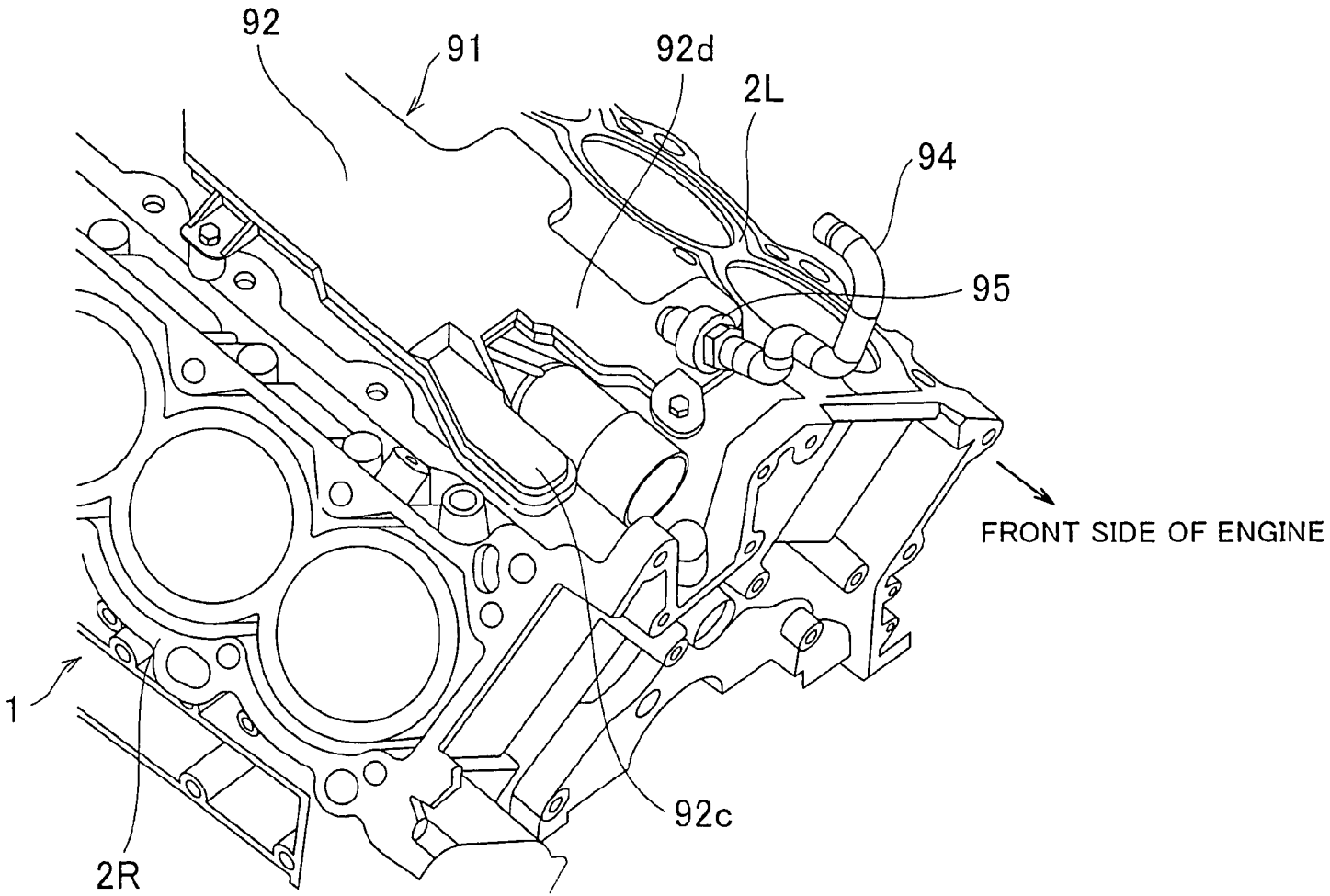
FIG. 3 is a perspective view showing a condition in which an oil separator is mounted on a cylinder block, as viewed from the front of the engine.
Figure 4:
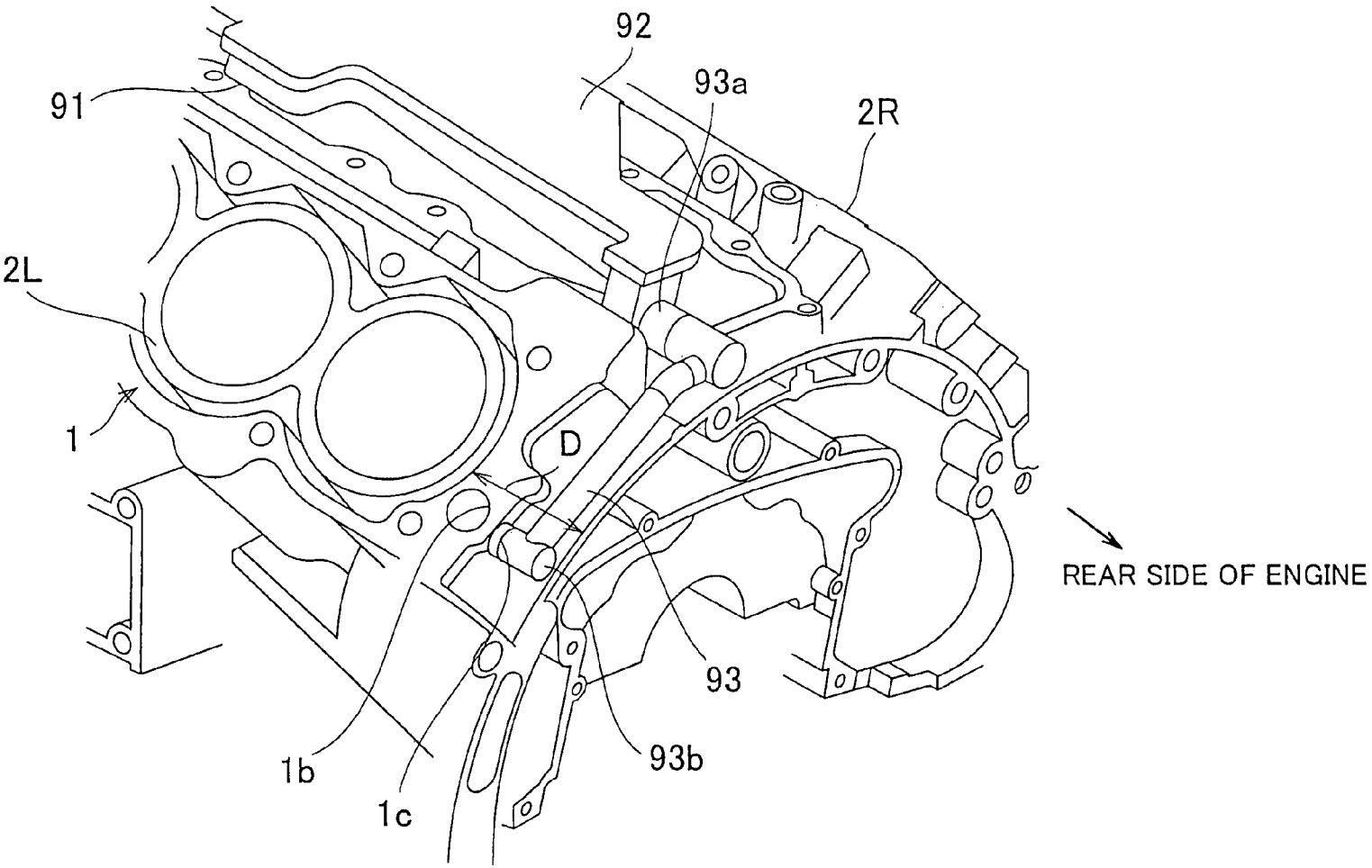
FIG. 4 is a perspective view showing a condition in which the oil separator is mounted on the cylinder block, as viewed from the rear of the engine.
Figure 5:
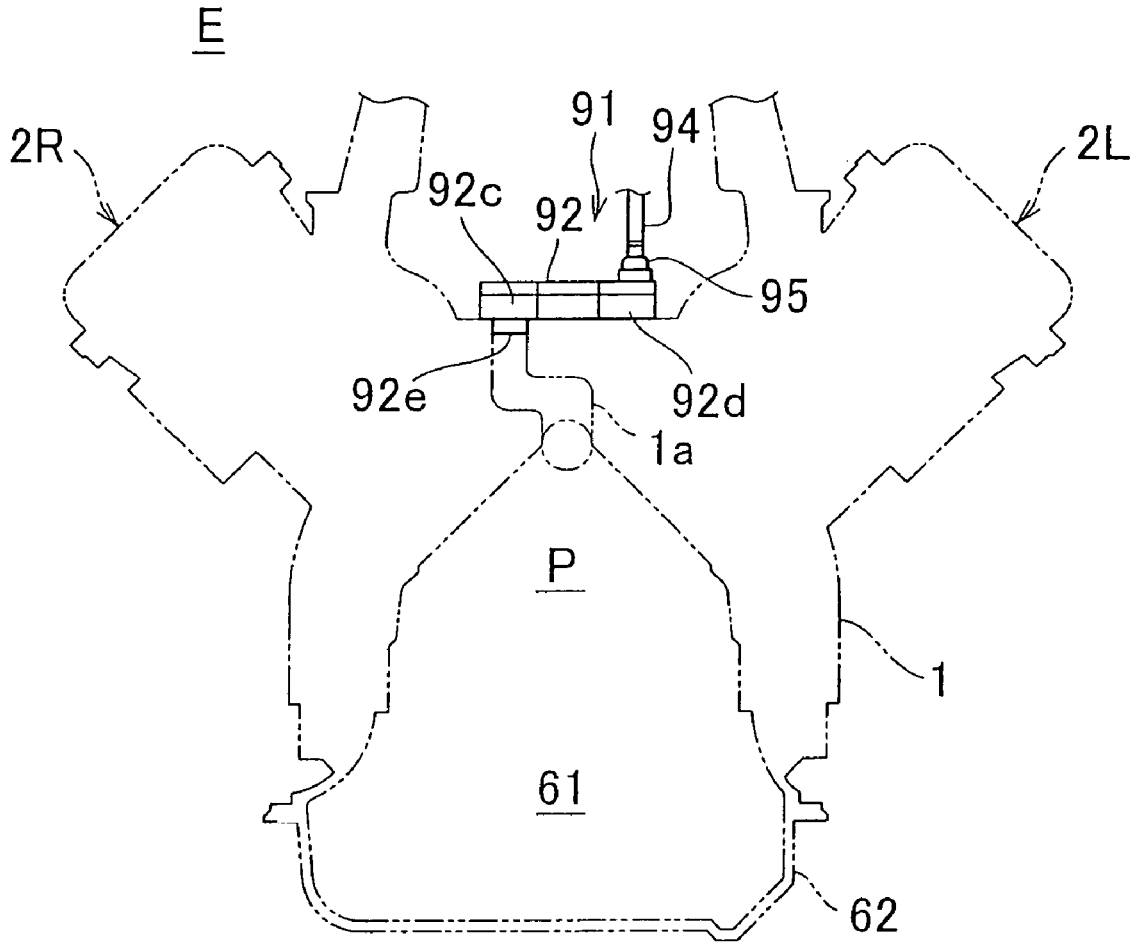
FIG. 5 is a view showing a mounting condition of the oil separator as viewed from the front of the engine.
Figure 6:
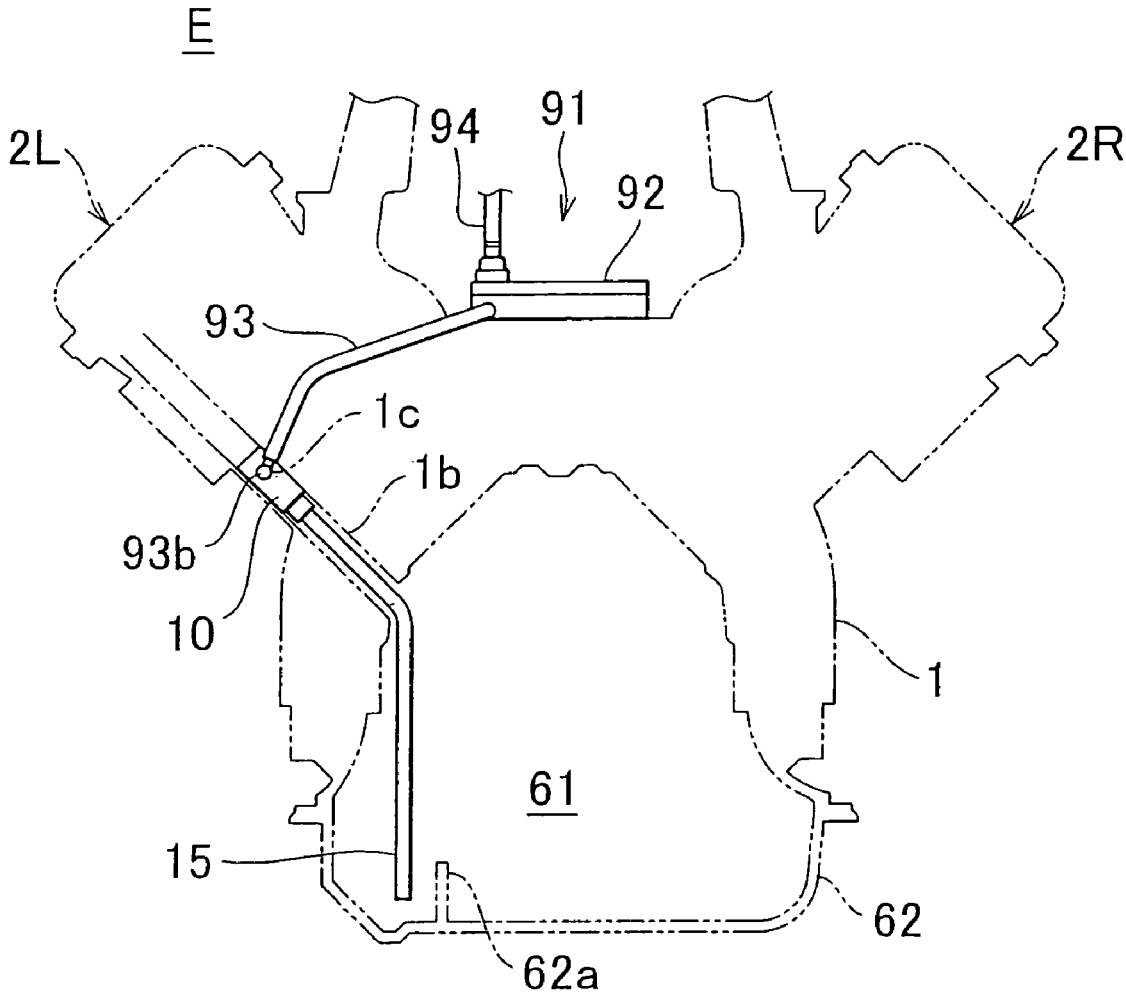
FIG. 6 is a view showing a mounting condition of the oil separator as viewed from the rear of the engine.
Figure 7:
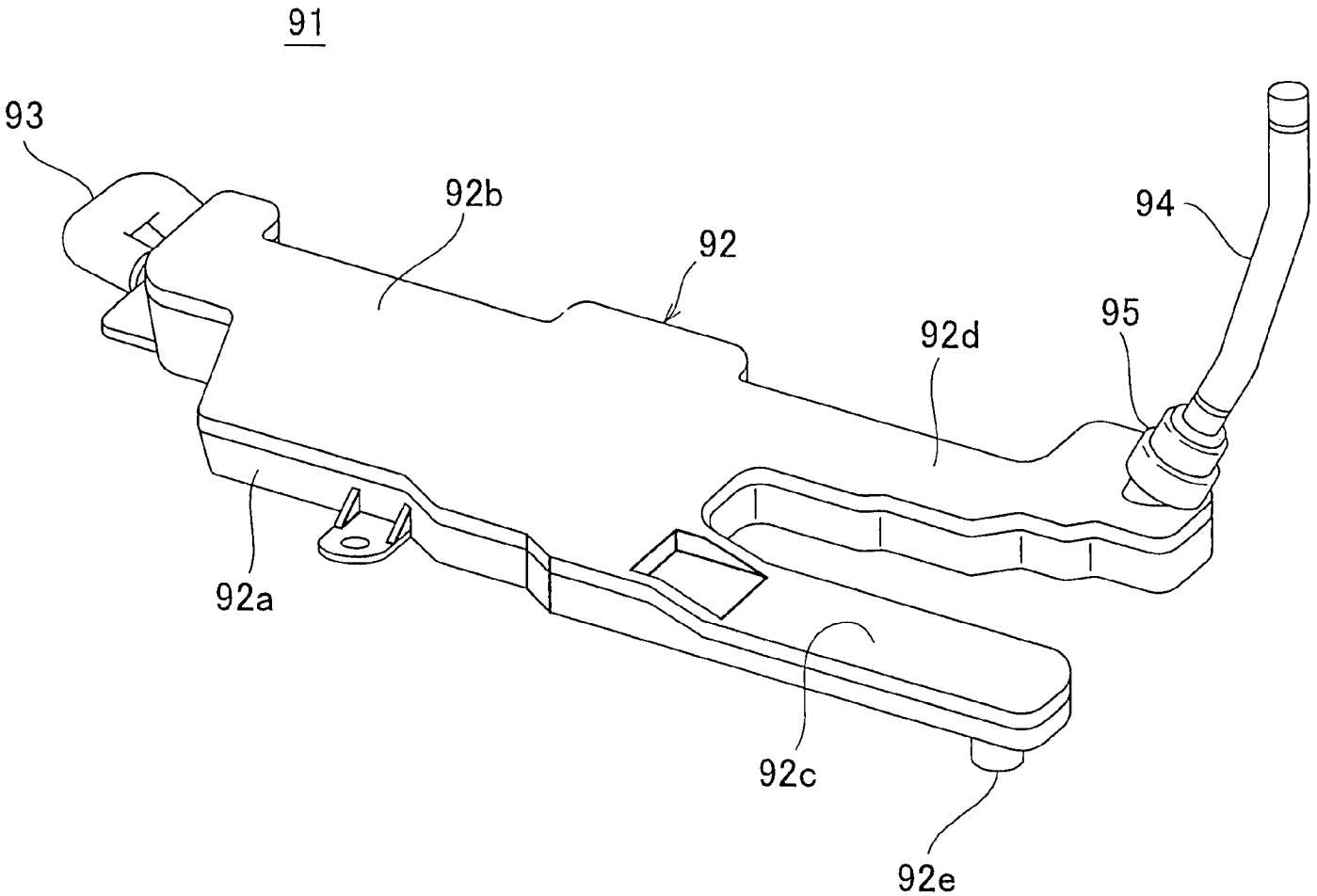
FIG. 7 is a perspective view of the oil separator.

The PCV system 9 includes an oil separator 91 located between the two banks 2L, 2R on the cylinder block 1. The oil separator 91 includes a separator case 92, and oil discharge pipe 93 and blow-by discharge hose 94 respectively connected to the separator case 92, as shown in FIG. 3 through FIG. 6. FIG. 3 and FIG. 4 are perspective views illustrating a condition in which the oil separator 91 is mounted on the cylinder block 1. Specifically, FIG. 3 shows the oil separator 91 as viewed from the front of the engine, while FIG. 4 shows the oil separator 91 as viewed from the rear of the engine. FIG. 5 and FIG. 6 illustrate a condition in which the oil separator 91 is mounted between the banks 2L, 2R. In these figures, the outline of the engine E and the shape of the crank chamber 61 are indicated by phantom lines. Specifically, FIG. 5 shows the oil separator 91 as viewed from the front of the engine, while FIG. 6 shows the oil separator 91 as viewed from the rear of the engine. FIG. 7 is a perspective view of the oil separator 91.

In the following, each constituent member of the oil separator 91 will be described in detail.

The separator case 92, which serves to separate oil mist from blow-by gas vented from the crank chamber 61 through a blow-by ventilation path P, is mounted on the upper surface of the cylinder block 1 between the two banks 2L, 2R by means of, for example, bolts. The blow-by ventilation path P is formed using space between the cylinder block 1 and a chain cover attached to the front face of the cylinder block 1 (i.e., space in which the timing chain is placed). Thus, the blow-by ventilation path P communicates at the lower end with the crank chamber 61. In operation, the blow-by gas that has been blown into the crank chamber 61 is caused to flow upward through the blow-by ventilation path P due to a pressure difference between the internal pressure of the crank chamber 61 and the internal pressure of the separator case 92.

As shown in FIG. 5, a blow-by gas passage 1*a* is formed in the cylinder block 1 such that its one end is open to the blow-by ventilation path P, and the other end is open to the upper face of the cylinder block 1 between the two banks 2L, 2R. The blow-by gas passage 1*a* communicates with a blow-by gas inlet 92*e* (which will be described later) of the separator case 92. With this arrangement, the blow-by gas in the blow-by ventilation path P is introduced into the separator case 92 via the blow-by gas passage 1*a* and the blow-by gas inlet 92*e*.

As shown in FIG. 7, the separator case 92 principally consists of a lower case 92*a* and an upper case 92*b*, which are made of resin and are integrally assembled together by vibration welding, or the like, such that a blow-by gas channel is formed inside the separator case 92. More specifically, the separator case 92 is in the form of a container whose longitudinal direction is parallel to the axis of the crankshaft C, as shown in FIG. 3 and FIG. 4, and an oil separating mechanism comprised of, for example, a punching plate(s) and/or a baffle plate(s) is housed in the separator case 92.

The separator case 92 is bifurcated at one longitudinal side (on the front side of the engine E) into a blow-by gas entry portion 92*c* and a blow-by gas discharge portion 92*d*. The above-mentioned blow-by gas inlet 92*e* is formed in the bottom face of the blow-by gas entry portion 92*c*, whereas a blow-by gas outlet is formed in the upper face of the blow-by gas discharge portion 92*d*. Also, an oil outlet is formed in a side face of the separator case 92 at the other longitudinal side (the rear side of the engine E). The above-mentioned blow-by discharge hose 94 is connected to the blow-by gas outlet of the blow-by gas discharge portion 92*d*, and the above-mentioned oil discharge pipe 93 is connected to the oil outlet.

In operation, oil mist is separated from the blow-by gas by the oil separating mechanism in the interior of the separator case 92, and the blow-by gas is then caused to flow out of the blow-by gas outlet, into the blow-by discharge hose 94.

On the other hand, the oil that has been separated from the blow-by gas reaches the oil outlet, and flows down toward the oil pan 62 through the oil discharge pipe 93. An arrangement for collecting the oil will be described later.

The separator case 92 is appropriately designed, for example, the capacity of the case 92 and the dimensions of its openings are appropriately determined, so as to achieve desired blow-by gas ventilation capability suitable for the displacement of the engine E, the amount of the blow-by gas produced, and so forth.

The blow-by discharge hose 94 is a pipe or conduit for directing the blow-by gas from which oil has been separated and removed in the separator case 92, to the intake system. As described above, the upstream end of the blow-by discharge hose 94 is connected to the blow-by gas outlet of the blow-by gas discharge portion 92*d*, and the downstream end is connected to the surge tank 71. Through the blow-by discharge hose 94, the blow-by gas is returned to the intake system of the engine E via the surge tank 71.

A PCV valve 95 is provided in an upstream end portion of the blow-by discharge hose 94. When the PCV valve 95 is opened under the intake vacuum, or the like, the blow-by gas in the separator case 92 is caused to flow out into the blow-by discharge hose 94, to be introduced into the surge tank 71.

Figure 8:
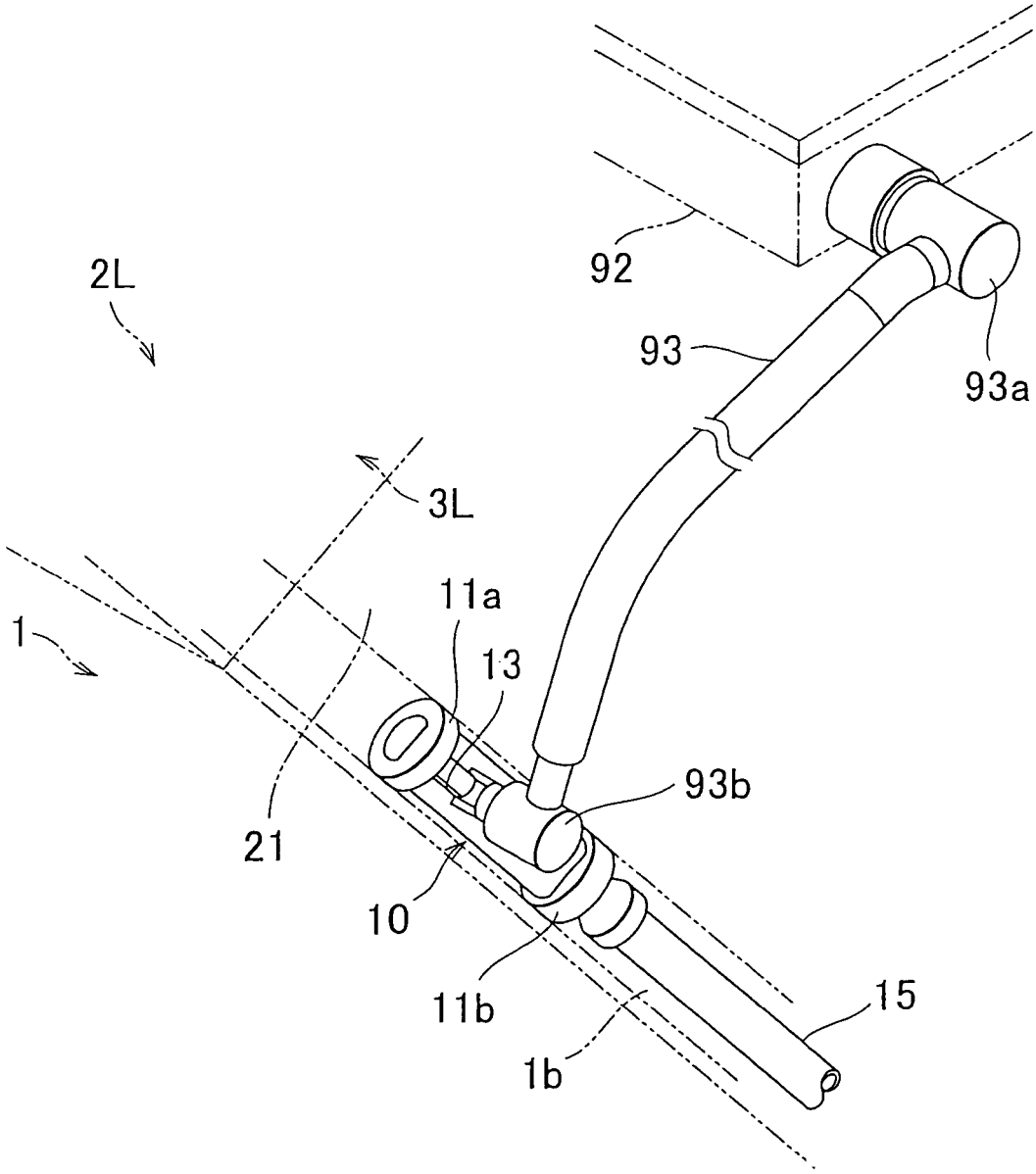
FIG. 8 is a perspective view in which an oil discharge pipe and a heat exchanger are indicated by solid lines, and a separator case and a left bank are indicated by phantom lines.

The oil discharge pipe 93 is used for feeding the oil separated from the blow-by gas in the separator case 92 back to the oil pan 62, as described above. As shown in FIG. 4, FIG. 6 and FIG. 8 (in FIG. 8, the oil discharge pipe 93 and a heat exchanger 10 that will be described later are indicated by solid lines, and the separator case 92 and the left bank 2L are indicated by phantom lines), the upstream end of the oil discharge pipe 93 is connected to the oil outlet formed in the side face of the separator case 92, and the downstream end of the pipe 93 is connected to a rear face 21 of one of the banks (the left bank 2L in this embodiment) of the cylinder block 1.

Figure 9A:
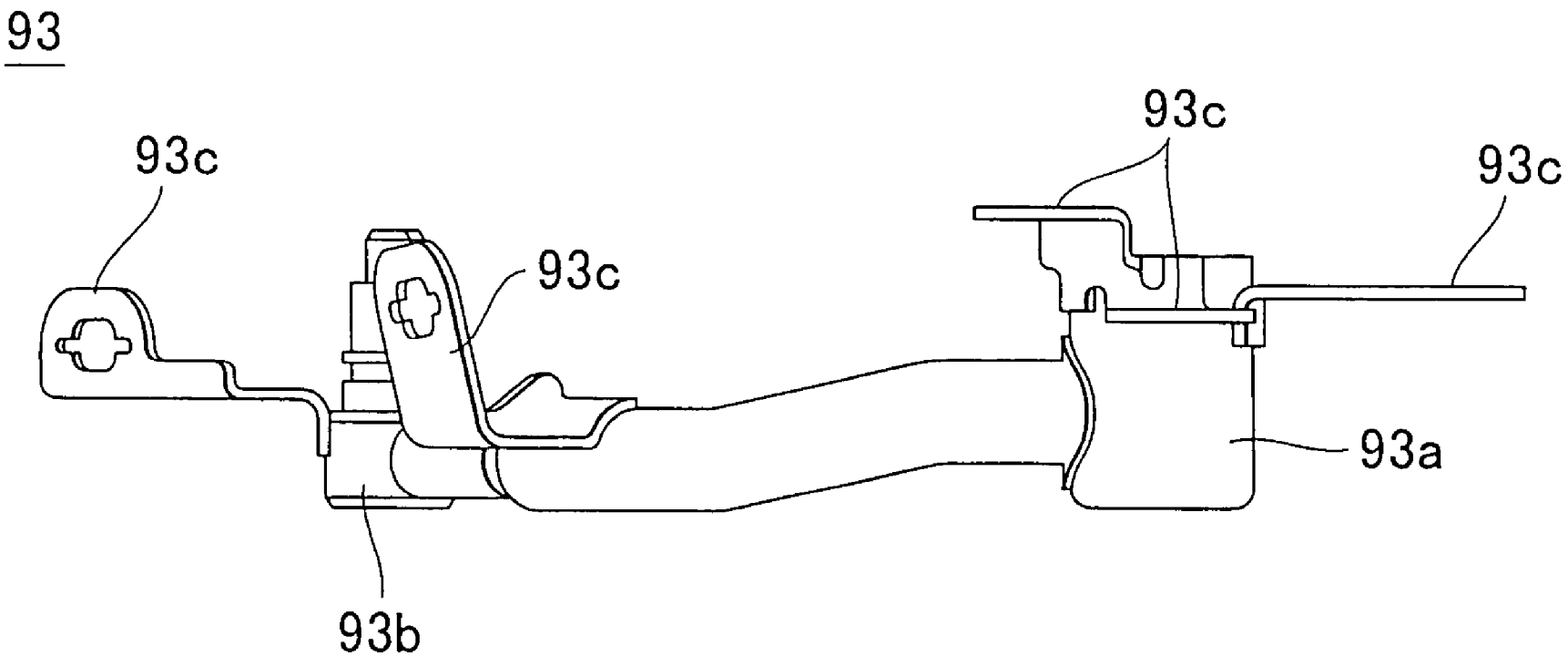
FIG. 9A is a plan view of the oil discharge pipe.
Figure 9B:
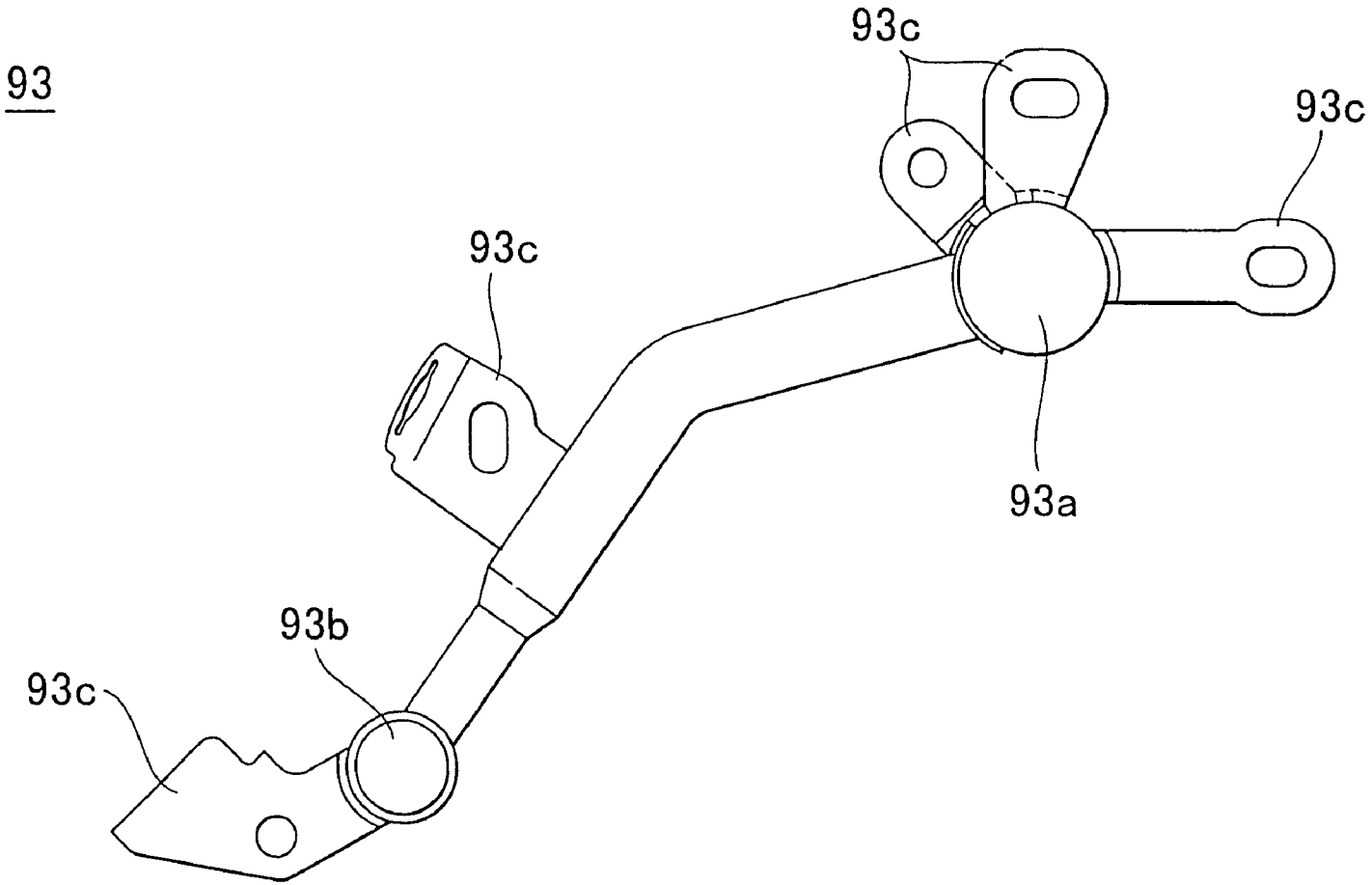
FIG. 9B is a front view of the oil discharge pipe.

FIG. 9A is a plan view of the oil discharge pipe 93, and FIG. 9B is a front view of the oil discharge pipe 93. As shown in FIGS. 9A and 9B, the oil discharge pipe 93 has an upstream-side connector 93*a* connected to the oil outlet of the separator case 92, and a downstream-side connector 93*b* connected to the rear face 21 of the cylinder block 1. The oil discharge pipe 93 is also supported on the rear face 21 of the cylinder block 1 with a plurality of brackets 93*c*, 93*c*, . . .

An oil return passage 1*b* that extends from the cylinder head 3L to the cylinder block 1 is formed inside the left bank 2L of the cylinder block 1. The upper end of the oil return passage 1*b* is open to the cam chamber 41L, and the lower end is open to the crank chamber 61. A connection opening 1*c* is formed in the rear face 21 of the cylinder block 1 at a position opposed to the oil return passage 1*b*, as shown in FIG. 6. In operation, oil that has been supplied into the cam chamber 41L and used for lubricating a valve actuating system(s) flows into the oil return passage 1*b*, to be directed toward the oil pan 62. The downstream end of the above-mentioned oil discharge pipe 93 is connected to the connection opening 1*c* via the downstream-side connector 93*b*.

The location at which the oil return passage 1*b* is formed will be explained. As described above, the engine E according to the present embodiment is a V-type engine. In this type of engine, the mutually opposed cylinders 5L, 5R of the two banks 2L, 2R are offset or displaced from each other in the direction in which the cylinders of each bank are aligned (i.e., in the longitudinal direction of each bank), so that the connecting rods 52L, 52R of the banks 2L, 2R are prevented from interfering with each other. Thus, each of the banks 2L, 2R is provided at one side as viewed in the direction of cylinder alignment with dead space that is opposed to the other bank. More specifically, in the engine E of this embodiment, the left bank 2L is slightly offset to the front from the right bank 2R in the direction of cylinder alignment, as shown in FIG. 3 and FIG. 4. Therefore, the above-mentioned dead space exists on the rear side of the left bank 2L as viewed in the direction of cylinder alignment, and also on the front side of the right bank 2R as viewed in the direction of cylinder alignment. Range D shown in FIG. 4 represents the dead space formed on the rear side of the left bank 2L as viewed in the direction of cylinder alignment.

In the present embodiment, the oil return passage 1*b* is formed in the dead space D on the rear side of the left bank 2L as viewed in the direction of cylinder alignment. This arrangement makes it possible to effectively utilize the dead space D, and provide the oil return passage 1*b* having a relatively large diameter without increasing the size of the engine E. The oil return passage 1*b* having such a large diameter assures a high capability of collecting oil for reuse.

As one feature of the present embodiment, the heat exchanger 10 is housed in the oil return passage 1*b* formed inside the cylinder block 1. The heat exchanger 10 causes heat exchange between oil that flows from the cam chamber 41L into the oil return passage 1*b* and oil that flows into the oil discharge pipe 93 after being separated from the blow-by gas in the separator case 92, without merging the two streams of oil with each other. In the following description, in order to distinguish the two streams of oil from each other, the oil that flows from the cam chamber 41L into the oil return passage 1*b* will be called "lubricating oil", and the oil that flows into the oil discharge pipe 93 after being separated from the blow-by gas in the oil separator 91 will be called "separated oil". The heat exchanger 10 will be now described in detail.

Figure 10:
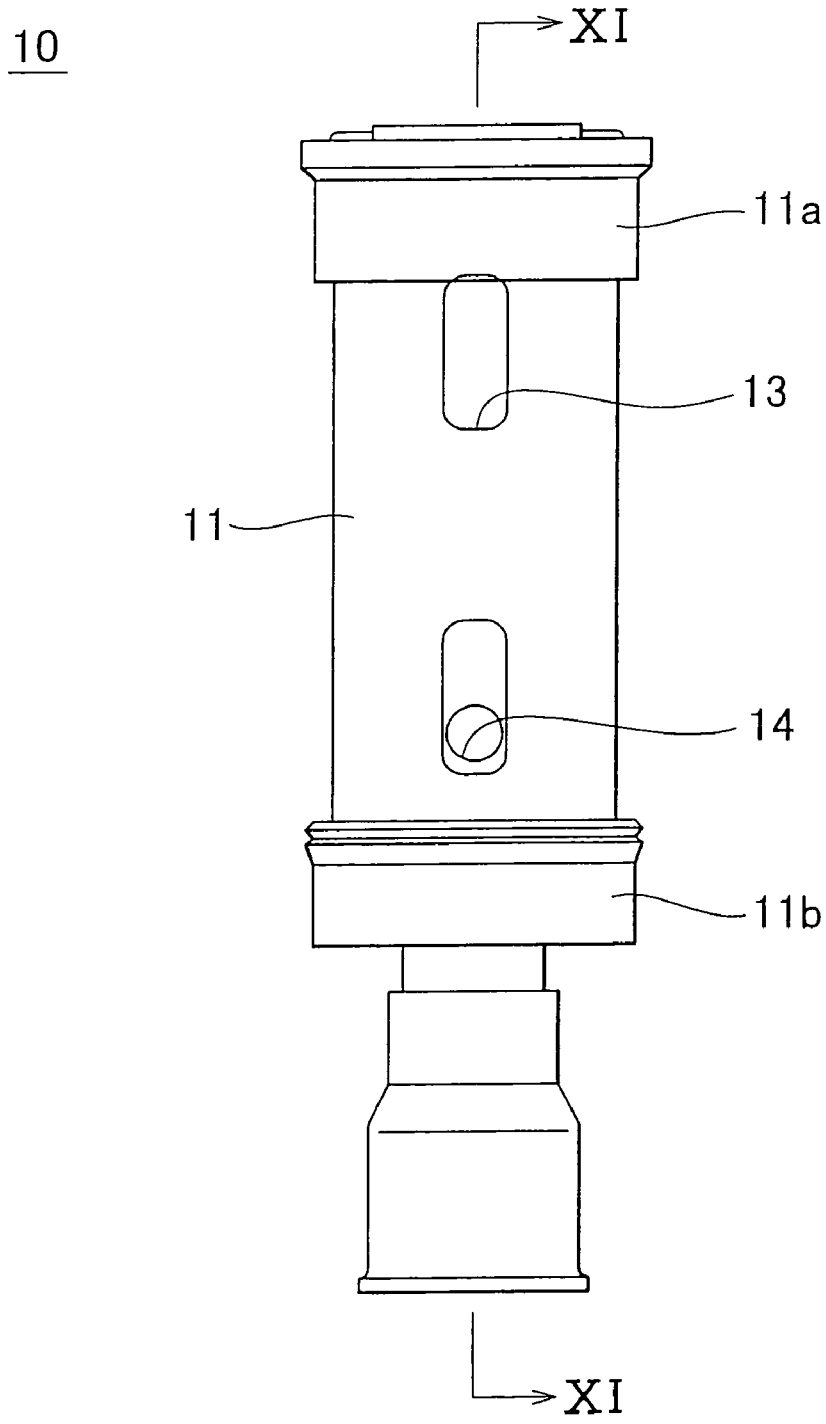
FIG. 10 is a front view of the heat exchanger.
Figure 11A:
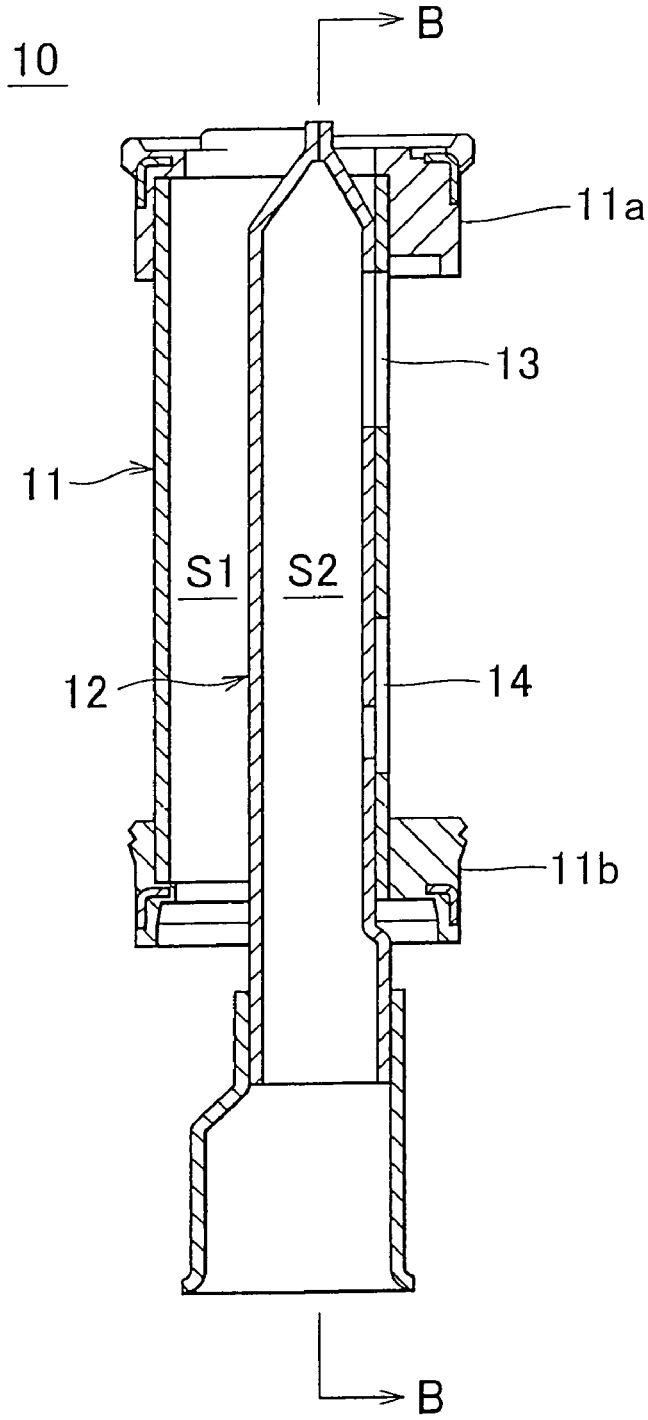
FIG. 11A is a cross-sectional view taken along line XI-XI in FIG. 10.

FIG. 10 is a front view of the heat exchanger 10. FIG. 11A is a cross-sectional view of the heat exchanger 10 taken along line XI-XI in FIG. 10, and FIG. 11B is a cross-sectional view of the heat exchanger 10 taken along line B-B in FIG. 11A.

Figure 11B:
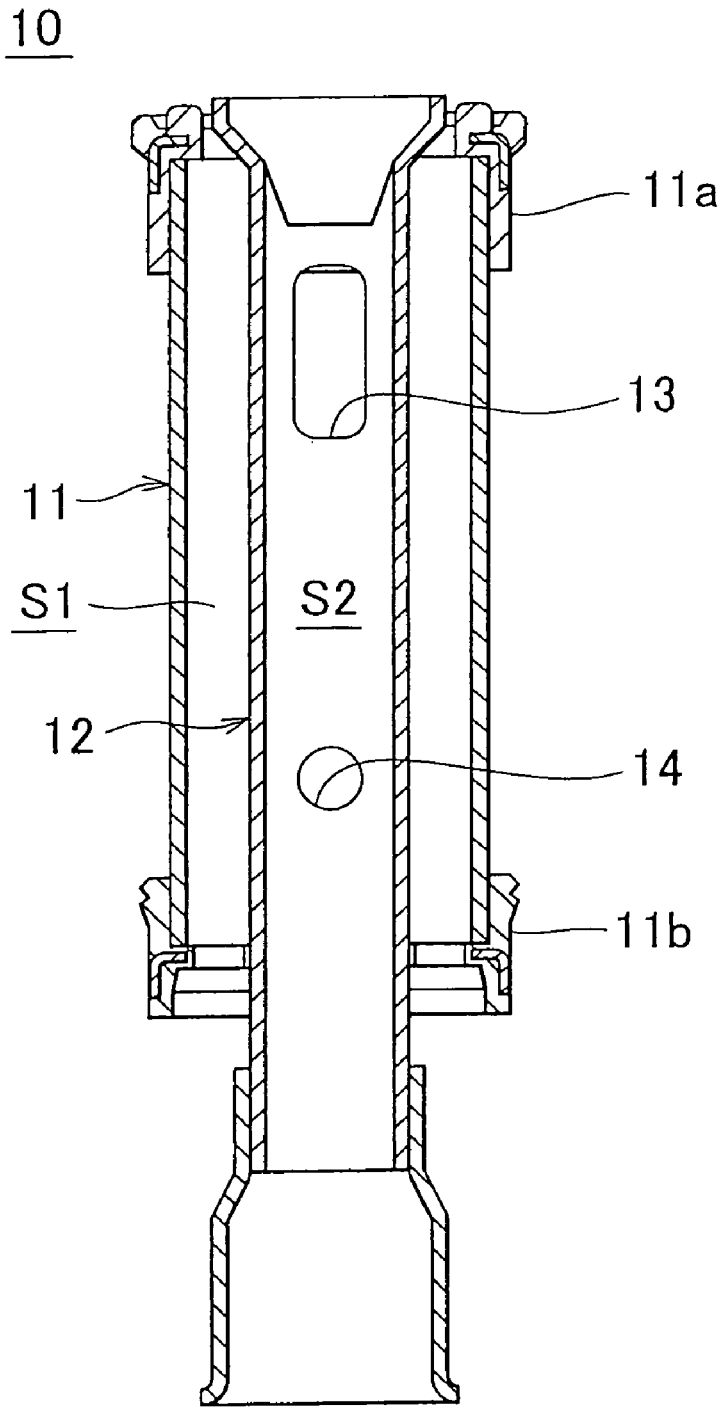
FIG. 11B is a cross-sectional view of the heat exchanger, taken along line B-B in FIG. 11A.

As shown in FIGS. 10, 11A and 11B, the heat exchanger 10 principally consists of outer pipe 11 and inner pipe 12 that are integrally joined to each other. The outer pipe 11 is in the form of a metallic cylindrical body having an outside diameter slightly smaller than the inside diameter of the oil return passage 1*b*, and rubber packings 11*a*, 11*b* are fitted in the upper and lower end portions of the outer pipe 11, respectively. The outside diameter of the rubber packings 11*a*, 11*b* is set to be equal to or slightly larger than the inside diameter of the oil return passage 1*b*. Thus, in a condition where the heat exchanger 10 is housed in the oil return passage 1*b*, the rubber packings 11*a*, 11*b* are held in intimate contact with the inner wall of the oil return passage 1*b*, thereby to hold the heat exchanger 10 in place in the oil return passage 1*b* while assuring fluid tightness or seal at the outer periphery of the heat exchanger 10.

On the other hand, the inner pipe 12, which is in the form of a metallic cylindrical body having an outside diameter that is about half of the outside diameter of the outer pipe 11, is integrally joined to the inner circumferential surface of the outer pipe 11 by welding, or the like. The mating faces of the outer pipe 11 and inner pipe 12 are formed by flat surfaces. The upper end portion of the inner pipe 12 becomes flatter on top and is closed at the top end. Thus, the inner pipe 12 is formed as a cylindrical body that is open downward.

At two positions (upper and lower positions) of the mating faces of the outer pipe 11 and inner pipe 12, communication holes 13, 14 are formed which communicate with the outside space of the outer pipe 11 and the inside space of the inner pipe 12. The upper communication hole 13 allows the separated oil flowing through the oil discharge pipe 93 to be introduced into the inside space (separated-oil collection passage) S2 of the inner pipe 12, and the lower communication hole 14 allows the separated oil flowing into space between the outer pipe 11 and the inner wall of the oil return passage 1*b* to be introduced into the inside space S2 of the inner pipe 12.

Thus, the heat exchanger 10 has a double-pipe structure consisting of two pipes 11, 12, and the lubricating oil that falls from the cam chamber 41L flows through the outer space (i.e., space between the inner surface of the outer pipe 11 and the outer surface of the inner pipe 12) S1 of the double-pipe structure. On the other hand, the separated oil (i.e., oil separated by the oil separator 91) that has passed the oil discharge pipe 93 flows through the inner space (the inside space of the inner pipe 12) S2 of the double-pipe structure. The space S2 may also be called "oil-collection inner passage" when appropriate.

Figure 12:
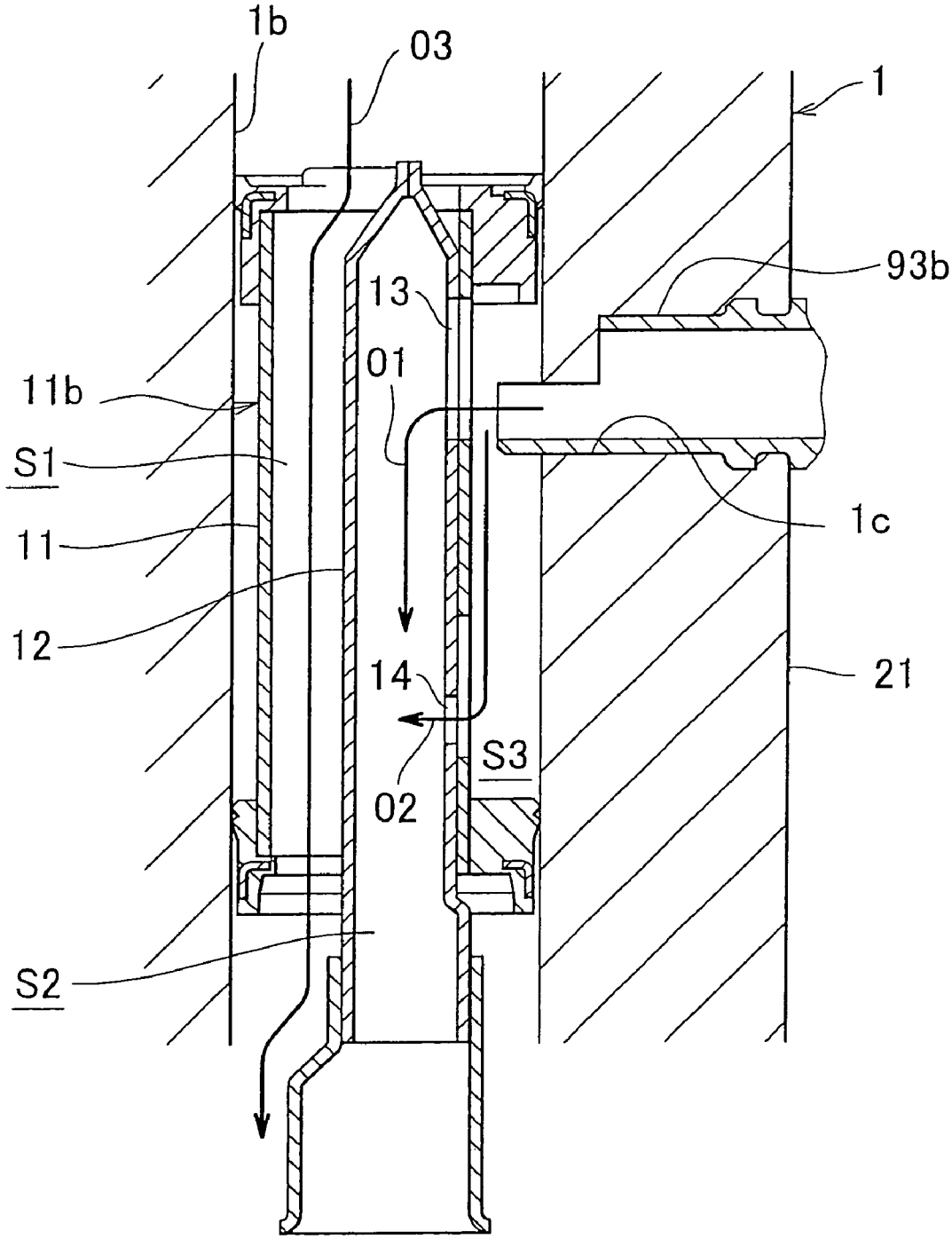
FIG. 12 is a view in which the cylinder block is cut along a direction of extension of an oil return passage, and which shows the positional relationship between the heat exchanger and a downstream-side connector.

FIG. 12 shows the cylinder block 1 that is cut along the direction of extension of the oil return passage 1*b*. More specifically, FIG. 12 shows the positional relationship between the heat exchanger 10 housed in the oil return passage 1*b*, and the downstream-side connector 93*b* as the downstream end of the oil discharge pipe 93 which is connected to the connection opening 1*c* formed in the rear face 21 of the cylinder block 1.

As shown in FIG. 12, the downstream-side connector 93*b* faces the upper communication hole 13 of the heat exchanger 10, and a large portion of the separated oil that flows out of the downstream-side connector 93*b* is introduced into the inside space S2 of the inner pipe 12 through the upper communication hole 13, as indicated by arrow O1 in FIG. 12. Meanwhile, a portion of the separated oil flows into space S3 between the outer pipe 11 and the inner wall of the oil return passage 1*b*, and accumulates in the space S3. If the amount of the accumulated oil exceeds a certain amount, the oil is introduced into the inside space S2 of the inner pipe 12 through the lower communication hole 14, as indicated by arrow O2 in FIG. 12.

The lower end of the outer pipe 11 is open to the interior of the oil return passage 1*b*. Therefore, the lubricating oil that has passed the oil-collection outer passage S1 flows out of the heat exchanger 10 into the oil return passage 1*b* (as indicated by arrow O3 in FIG. 12), and flows down toward the oil pan 62 along the inner wall of the crank chamber 61.

Figure 13A:
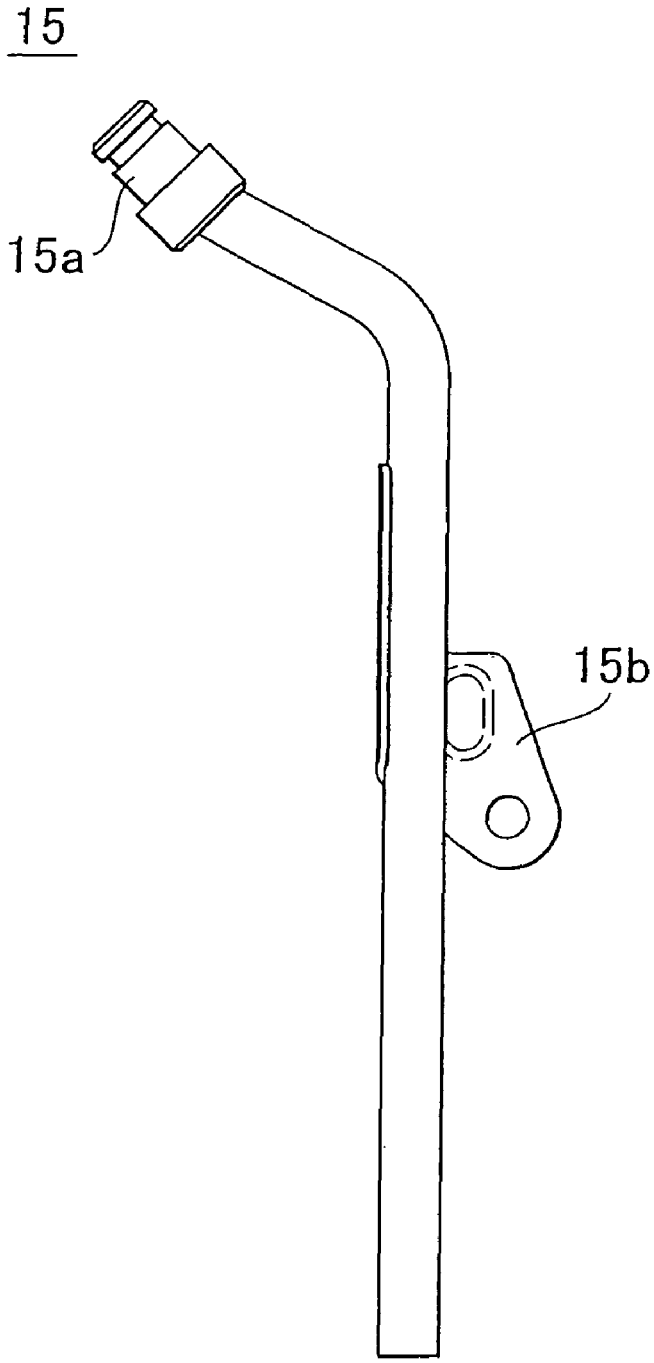
FIG. 13A is a front view of an oil collection pipe.
Figure 13B:
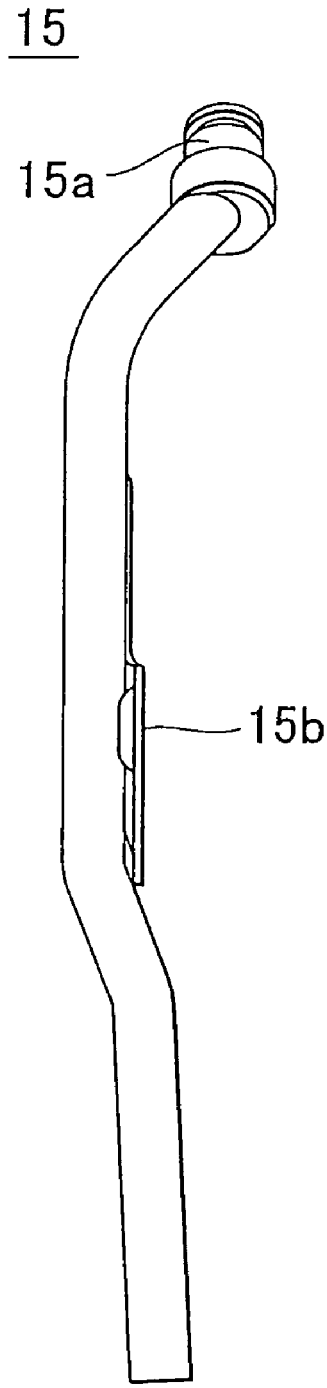
FIG. 13B is a side view of the oil collection pipe.

On the other hand, the inner pipe 12 is connected at its lower end to an oil collection pipe 15. FIG. 13A is a front view of the oil collection pipe 15, and FIG. 13B is a side view of the oil collection pipe 15. As shown in FIGS. 13A and 13B, the oil collection pipe 15 is provided at its upper end with a connector 15*a*, and the connector 15*a* is inserted into the lower end of the inner pipe 12 of the heat exchanger 10, to be connected to the inner pipe 12. The oil collection pipe 15 extends downward such that its lower end reaches the vicinity of the bottom of the oil pan 62 and is immersed in the oil stored in the oil pan 62, as shown in FIG. 1 and FIG. 6. The oil collection pipe 15 is supported on the inner wall of the crank chamber 61 with a mounting bracket 15*b*.

Figure 14:
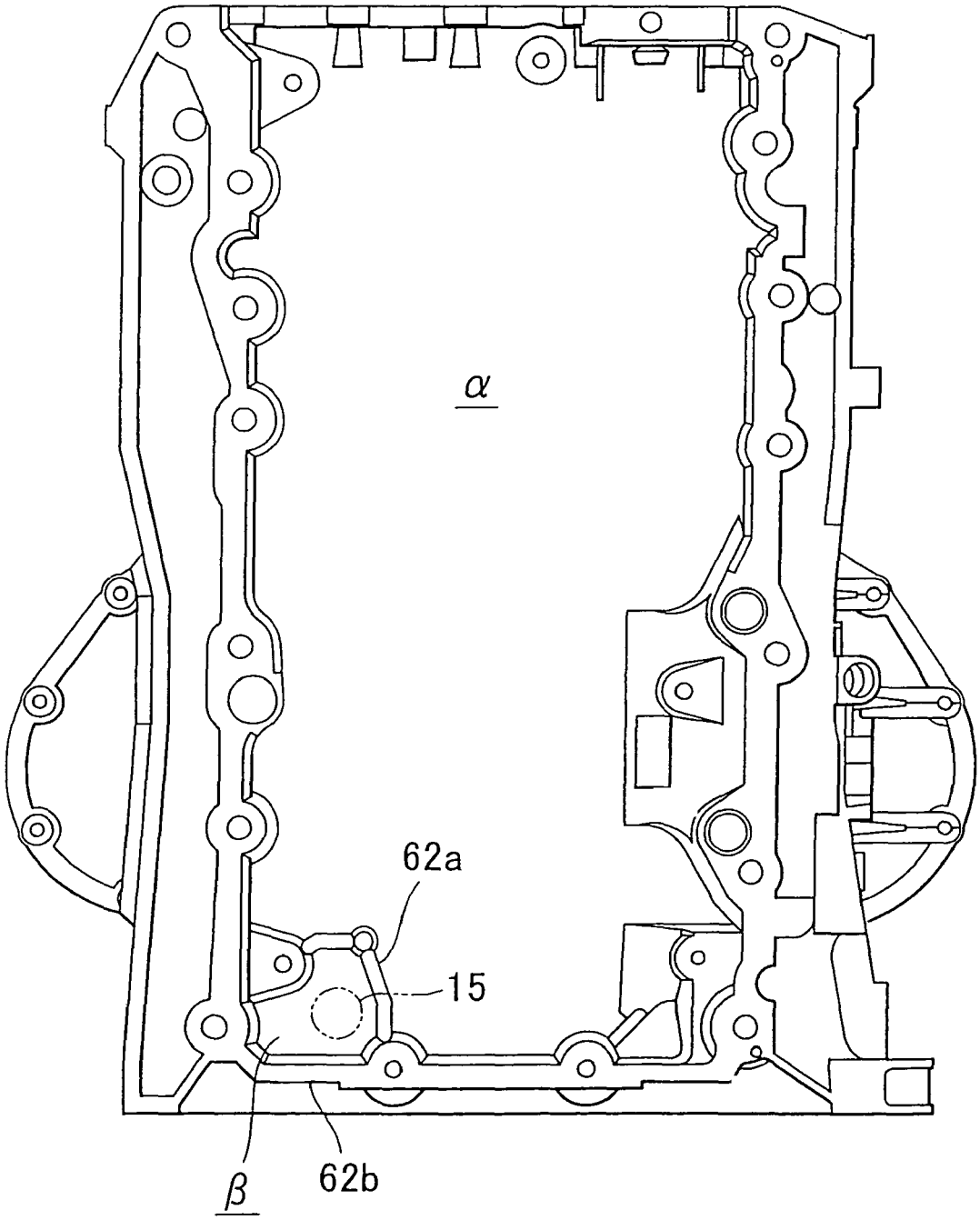
FIG. 14 is a plan view of an oil pan.

FIG. 14 is a plan view of the oil pan 62. As shown in FIG. 14, a partition wall 62*a* that rises upward from the bottom of the oil pan 62 is provided in a corner portion (a lower, left corner portion in FIG. 14) of the oil pan 62, and an oil reserving space β is formed or defined by the partition wall 62*a* and an outer circumferential wall 62*b* of the oil pan 62. The oil reserving space β is isolated by the partition wall 62*a* from oil storage space α located in the central portion of the oil pan 62, and a certain amount or more of oil is constantly stored in the space β. The lower end of the oil collection pipe 15 is immersed in the oil stored in the oil reserving space β. A phantom line in FIG. 14 indicates the position at which the oil collection pipe 15 is inserted, relative to the oil reserving space β.

As described above, the respective streams of oil (i.e., the lubricating oil and the separated oil) that have entered the heat exchanger 10 flow through difference spaces S1, S2, and are individually collected into the oil pan 62.

Next, the operation of the PCV system 9 constructed as described above and the effects of the heat exchanger 10 will be described. The blow-by gas blowing into the crank chamber 61 through clearances between the cylinders 5L, 5R and the pistons 51L, 51R during the compression or expansion stroke of the engine E passes the blow-by ventilation path P in the form of space between the cylinder block 1 and the chain cover unit, and is then introduced into the separator case 92 through the blow-by gas passage 1*a* and the blow-by gas inlet 92*e*. The blow-by gas fed into the separator case 92 is subjected to the oil separating mechanism, so that oil mist is separated from the blow-by gas.

Then, the blow-by gas from which the oil mist has been separated and removed reaches the blow-by gas outlet of the blow-by gas discharge portion 92*d* of the separator case 92, and is delivered into the blow-by discharge hose 94 when the PCV valve 95 is opened, to be thus introduced into the intake system via the surge tank 71.

On the other hand, the separated oil obtained after treatment of the blow-by gas reaches the oil outlet of the separator case 92, and is discharged into the oil discharge pipe 93. The separated oil that has passed the oil discharge pipe 93 is then introduced into the inside space (oil-collection inner passage) S2 of the inner pipe 12 of the heat exchanger 10 having the double-pipe structure. While the separated oil is flowing through the inside space S2, heat exchange takes place between the separated oil and the lubricating oil flowing through the oil-collection outer passage S1 in the form of a space between the inner surface of the outer pipe 11 and the outer surface of the inner pipe 12.

Since the lubricating oil flows from the cam chamber 41L into the oil-collection outer passage S1 after lubricating the camshafts 35L, 36L and others, the oil is subjected to heat from the cylinder head 3L and the cylinder block 1, and is thus heated to a relatively high temperature (for example, 80° C.). Thus, the temperature of the lubricating oil becomes higher than the separated oil flowing from the oil separator 91 into the oil-collection inner passage S2 via the oil discharge pipe 93. Therefore, the heat of the lubricating oil flowing through the oil-collection outer passage S1 (as indicated by arrow O3 in FIG. 12) is imparted to the separated oil flowing through the oil-collection inner passage S2 (as indicated by arrows O1, O2 in FIG. 12), to thus raise the temperature of the separated oil.

As the temperature of the separated oil rises in the above manner, water contained in the separated oil is evaporated, and the amount of water flowing into the oil pan 62 is reduced. As a result, an otherwise possible increase in the water content of the oil stored in the oil pan 62 can be suppressed, and the possibility of production of sludge due to the union of water and nitrogen oxides (NOx) contained in the blow-by gas can be reduced. Consequently, the oil is prevented from degrading due to the sludge. Also, the blow-by ventilation path, and/or other path(s), is/are prevented from being blocked by or clogged with the sludge, which is detrimental to smooth blow-by ventilation. Thus, the system of this embodiment provides a high capability of separating and collecting the oil from the blow-by gas.

The separated oil that has passed the heat exchanger 10 flows down into the oil reserving space β of the oil pan 62 through the oil collection pipe 15, and is thus collected for reuse.

The engine E is formed with a fresh-air introduction path through which fresh air is introduced into the crank chamber 61. Along with the above-described blow-by gas recirculating operation, fresh air is introduced into the crank chamber 61 through the fresh-air introduction path for ventilation of the crank chamber 61. For example, the fresh-air introduction path may be constructed such that part of air flowing in the intake pipe 73 is drawn into the crank chamber 61.

As described above, the lower end of the oil collection pipe 15 connected to the lower end of the inner pipe 12 of the heat exchanger 10 is immersed in the oil stored in the oil pan 62. This arrangement makes it possible to inhibit back-flow of the blow-by gas in the interior of the oil collection pipe 15 and the oil-collection inner passage S2 of the heat exchanger 10, thus favorably accomplishing "oil draining" of the oil separator 91.

Furthermore, the heat exchanger 10, which has a double-pipe structure, keeps or prevents the oil discharge pipe 93 from being exposed to airspace in the oil-collection outer passage S1. Since the intake vacuum for drawing the blow-by gas into the intake system of the engine E is applied to the interior of the separator case 92, the internal pressure of the separator case 92 is lower than the internal pressure of the oil-correction outer passage S1 especially during high-speed revolution of the engine E. With the above arrangement in which the oil-collection outer passage S1 and the separator case 92 are disconnected from each other, air in the oil-collection outer passage S1 is prevented from flowing into the separator case 92 via the oil discharge pipe 93. Accordingly, the oil trapped in the separator case 92 can be easily discharged into the oil pan 62 via the oil discharge pipe 93 and the oil-collection inner passage S2.

In the illustrated embodiment, the oil collecting structure according to the invention is employed in the V-type eight-cylinder engine for an automobile. It is, however, to be understood that the invention is not limited to this application, but may be equally applied to other types of engines, such as an in-line engine for an automobile and a horizontal opposed engine for an automobile. Also, the invention is not limitedly applied to engines for automobiles, but may be applied to other engines. Also, the number of cylinders, the angle formed between two banks in the V-type engine E, and other specifications of the engine E are not particularly limited to those of the illustrated embodiment.

In the illustrated embodiment, the invention is applied to the PCV system 9 having the separator case 92 mounted on the upper face of the cylinder block 1 between the two banks 2L, 2R. However, the invention is not limited to this case, but may be equally applied to a PCV system having a separator case mounted inside the head cover 4L, 4R.

In the illustrated embodiment, the heat exchanger 10 has a double-pipe structure, which allows the lubricating oil to flow through the oil-collection outer passage S1 and allows the separated oil to flow through the oil-collection inner passage S2. However, the invention is not limited to this arrangement, but may be applied to a heat exchanger in which the separated oil flows through the oil-collection outer passage S1, and the lubricating oil flows through the oil-collection inner passage S2. Also, the arrangement for permitting heat exchange between the lubricating oil and the separated oil is not limited to the double-pipe structure as described above, but may be otherwise constructed such that channels of the lubricating oil and separated oil are located adjacent to each other.

In the illustrated embodiment, the oil return passage 1*b* is formed in the dead space located on the rear side of the left bank 2L as viewed in the direction of cylinder alignment, and the heat exchanger 10 is also placed in the same dead space. However, the invention is not limited to this arrangement, but the oil return passage 1*b* and the heat exchanger 10 may be placed in dead space located on the front side of the right bank 2R as viewed in the direction of cylinder alignment.

While the invention has been described with reference to exemplary embodiments thereof, it is to be understood that the invention is not limited to the described embodiments or constructions. To the contrary, the invention is intended to cover various modifications and equivalent arrangements. In addition, while the various elements of the exemplary embodiments are shown in various combinations and configurations, other combinations and configurations, including more, less or only a single element, are also within the spirit and scope of the invention.

The invention claimed is:

1. An oil collecting structure of a blow-by gas recirculation system, comprising:

an oil separator that separates oil mist from a blow-by gas, and feeds the blow-by gas from which the oil mist is separated and removed to an intake system of an internal combustion engine while feeding the oil separated from the blow-by gas to an oil reservoir of the engine;

a separated-oil collection passage through which the oil separated from the blow-by gas by the oil separator is fed toward the oil reservoir, said separated-oil collection passage being formed in a main body of the engine and located adjacent to an oil return passage through which an oil used for lubricating the interior of the main body of the engine flows downward; and a heat exchanging portion in which heat of the oil flowing in the oil return passage is imparted to the oil flowing in the separated-oil collection passage.

2. An oil collecting structure of a blow-by gas recirculation system according to claim 1, wherein:

the heat exchanging portion in which the heat of the oil flowing in the oil return passage is imparted to the oil flowing in the separated-oil collection passage has a double-pipe structure having an outer channel and an inner channel; and one of the outer channel and the inner channel provides the oil return passage, and the other of the outer and inner channels provides the separated-oil collection passage.

3. An oil collecting structure of a blow-by gas recirculation system according to claim 2, wherein:

the outer channel of the heat exchanging portion provides the oil return passage, and communicates with an internal space of a cylinder head so as to collect the oil from the cylinder head; and the inner channel of the heat exchanging portion provides the separated-oil collection passage, and communicates with an internal space of the oil separator so as to collect the oil separated from the blow-by gas by the oil separator.

4. An oil collecting structure of a blow-by recirculation system according to claim 1, wherein the separated-oil collection passage has a downstream end that is immersed in an oil stored in the oil reservoir.

5. An oil collecting structure of a blow-by recirculation system according to claim 1, wherein:

the engine comprises a V-type multi-cylinder engine having a first bank and a second bank;

a plurality of cylinders provided in one of the first and second banks are offset from corresponding cylinders of the other of the first and second banks in a direction of cylinder alignment in which the cylinders of each of the banks are aligned;

each of the first and second banks has a dead space formed in one of opposite end portions thereof as viewed in the direction of cylinder alignment, said dead space of said each bank being opposed to the other bank; and the oil return passage and the separated-oil collection passage are placed in the dead space of one of the first and second banks.

6. An oil collecting device having an oil collecting structure of a blow-by gas recirculation system according to claim 1.

* * * * *